US006202760B1

(12) United States Patent
Lin

(10) Patent No.: US 6,202,760 B1
(45) Date of Patent: Mar. 20, 2001

(54) STRUCTURE OF MULTI-FUNCTIONAL HAND TOOL

(76) Inventor: Wu-Chang Lin, 6F, No.21, Lane 6, Zhuangjing Road, Sin Yi District, 110 Taipei (TW)

( * ) Notice: Subject to any disclaimer, the term of this patent is extended or adjusted under 35 U.S.C. 154(b) by 0 days.

(21) Appl. No.: 09/644,212

(22) Filed: Aug. 23, 2000

(51) Int. Cl.[7] ..... B25B 21/00

(52) U.S. Cl. ..... 173/109; 173/217; 173/132; 279/19.4; 279/19.7

(58) Field of Search ..... 173/109, 117, 173/217, 213, 132; 279/19.1, 19.2, 19.3, 19.4, 19.7; 81/475, 469

(56) References Cited

U.S. PATENT DOCUMENTS

| | | | | |
|---|---|---|---|---|
| 3,718,340 | * | 2/1973 | Stewart | 173/217 |
| 3,802,518 | * | 4/1974 | Albert | 173/217 |
| 4,091,880 | * | 5/1978 | Troutner et al. | 173/217 |
| 5,360,073 | * | 11/1994 | Akazawa | 81/475 |
| 5,765,652 | * | 6/1998 | Mathis et al. | 173/217 |
| 5,816,121 | * | 10/1998 | Yoshimizu et al. | 81/469 |

* cited by examiner

*Primary Examiner*—Scott A. Smith
(74) *Attorney, Agent, or Firm*—Bacon & Thomas, PLLC

(57) ABSTRACT

An improved structure of multi-functional hand tool, wherein, a pushing axle rod is screw connected with a chuck, a pushing axle rod is screw connected with a driving rod; bearings are slipped over a positioning sleeve, then the positioning sleeve, the pushing axle rod and the chuck are together placed in a pipe body with the bearings. The positioning sleeve can be rotated in the bearings. A front cover is locked in the front end of the pipe body; the chuck is extended out of the front cover. The pushing member is screwed in the pipe body to render a hole on a rear enlarged threaded portion of the pushing member to be exactly located at a position limiting slot of the pipe body. The external sleeve then is slipped over the pipe body, and an inner screw hole of the external sleeve is aligned with the position limiting slot of the pipe body. Then the positioning screw rod is screwed in the inner screw hole to extend through the position limiting slot and the hole of the pushing member. Thereby, the external sleeve pushes the pushing member when the external sleeve is rotated; the pushing member in turn moves the chuck into/out of the positioning sleeve to thereby insert/take a grinding member into/out of the chuck.

3 Claims, 9 Drawing Sheets

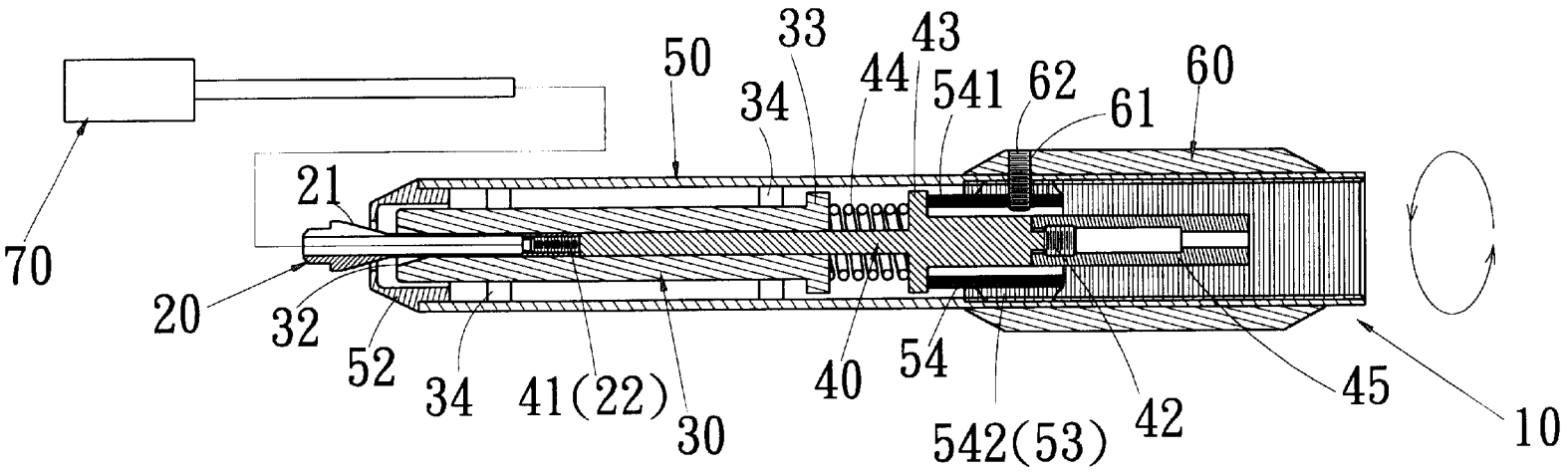
FUG. 5
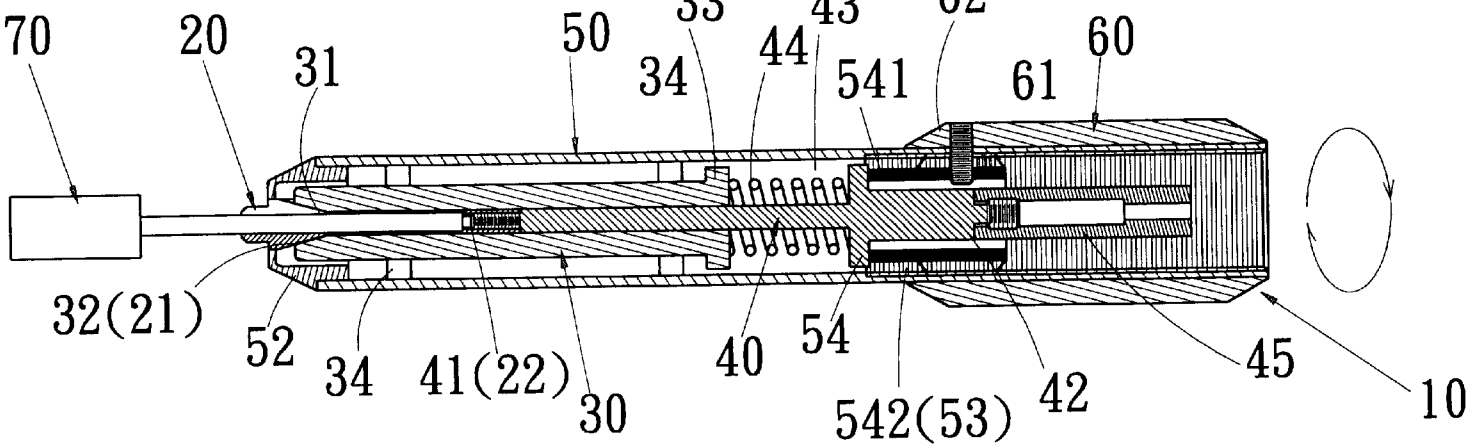
FIG. 6

STRUCTURE OF MULTI-FUNCTIONAL HAND TOOL

BACKGROUND OF THE INVENTION

1. Field of the Invention

The present invention is related to an improved structure of multi-functional hand tool, and especially to a hand tool capable of fast changing over grinding members for grinding, carving, polishing, cutting etc. The hand tool of the present invention is rotated by means of an external sleeve on the rear end of a pipe body to move a pushing axle rod to push a movable chuck out of a positioning sleeve, in order to insert a grinding member into the chuck; then the external sleeve pulls the chuck into the positioning sleeve to have the grinding member tightly clamped by the chuck. And then grinding operation can be executed, while the grinding member can be changed over with another one quickly.

2. Description of the Prior Art

Nails of a human body grow and get longer and longer, they need cutting once in a while. In addition to cutting, ladies generally make trimming of nails with files or grinding tools to give nails good appearance. And the nails can be trimmed into the shapes they prefer and can be polished to make the nails smoother, and then nail polish can be applied to increase beauty and brightness of the nails; otherwise, the nails can be stuck thereon artistic patterns, or artificial nails can be stuck on the real nails. Such a variety of ways of nail cosmetology can have trimming done with files, and also can get more detailed grinding with a multi-functional hand tool to make nails finer.

Ordinarily, repair and trimming of an instrument, such as polishing, carving, trimming rough edges, grinding, cutting and drilling etc. must have a hand tool held in a hand for a long time; conventional hand tools have heavier weight, they may make hands ache and thus are not desired. And conventional hand tools each has its pipe body A and a receiving rotational axle B connected with a set of bearings C (as shown in FIG. 1), the rotational axle B is provided on the front end thereof with an external thread D and an hole E to allow slipping of an elastic chuck F into the hole E, and a sleeve G with an inner thread is slipped over the elastic chuck F and is locked onto the external thread D on the front end of the rotational axle B. Before a grinding member H is inserted into the chuck F, a bolt pin J or a small wrench must be inserted into a hole K on the pipe body A and a positioning hole L on the rotational axle B, then the rotational axle B can be secured to prevent rotation, and the grinding member H can be inserted into the chuck F. Thereafter, the sleeve G is rotated to connect tightly with the external thread D, and the grinding member H is connected to the front end of the rotational axle B. Thereby, rotation of the rotational axle B can bring the grinding member H to rotate for grinding.

When in changing (or taking off) the grinding member H on the rotational axle B, the bolt pin J or the small wrench shall similarly be inserted into a hole K on the pipe body A and a positioning hole L on the rotational axle B, then the sleeve G can be rotated and removed from the front end of the rotational axle B to allow removing of the grinding member H from the chuck F.

In studying changing, insertion or taking off of the grinding member from the above conventional hand tool, a bolt pin or a small wrench has to be used to secure the rotational axle in order to screw tight or loosen the sleeve on the front end of the rotational axle, this is quite cumbersome and inconvenient. While various grinding members are wanted in various operation situations in pursuance of material of a work piece and requirements of repair, hence changing over of the grinding members is necessary from time to time. Although it is a trouble work in changing over, the work has to be done. And more, the bolt pin or the small wrench is an accessory separated from the hand tool, if it is unintentionally lost due to neglect, or it can not be found temporarily, a substitute is required to insert into the hole and positioning hole mentioned above to secure the rotational axle for rotating the sleeve on the front end of the rotational axle. This is a very troublesome hand tool, a user may consume a lot of time in changing over and mounting the grinding members, and thus efficiency of working may be influenced. Thereby, improvement is necessary.

SUMMARY OF THE INVENTION

In view that hand tools are important for repair or trimming of various articles, and conventional hand tools are cumbersome and inconvenient in use and have to be improved. The inventor provides the present invention based on his specific experience of manufacturing, designing, selling etc. for many years and after studying, improvement, development and repeated experiments, examinations and tests. By providing an external sleeve on the rear end of a pipe body to move a pushing axle rod to push/insert a movable chuck out of/into a positioning sleeve, in order to tighten or loosen a chuck to fast change over a grinding member and also to make accuracy of the position of the new grinding member.

The main object of the present invention is: by rotating the external sleeve on the rear end of the pipe body to move a pushing member in the pipe body to push the pushing axle rod and to move the chuck connected to the front end of the pushing axle rod out of/into a positioning sleeve for stretching out/converging, and a grinding member can be placed and clamped in the chuck (or taken out of the chuck).

The secondary object of the present invention is: the positioning sleeve has therein near the front end front end thereof a conical surface of a suitable slope to match a conical surface on the front end of the chuck. When the chuck gets into the positioning sleeve, the conical surface thereof will be confined by the conical surface of the positioning sleeve, and it will be released when it is extended out of the positioning sleeve.

The present invention has another object: the pipe body is provided at an area thereof connecting with the external sleeve with a recess for placing therein a bead and an elastic piece. The external sleeve is provided at an area therein opposite to that of the recess with a positioning hole. The bead in the recess is engaged in the positioning hole when the external sleeve is rotated to make alignment of the positioning hole with the recess, so that the external sleeve can be rotated quickly to be in position, thus the external sleeve has a function of limiting position.

The present invent ion has another object: the rear end of the pushing axle rod can be connected with the rotation axle of a motor, so that the motor can directly move the pushing axle rod to move in and out of the positioning sleeve.

The present invention will be apparent in its structure and features after reading the detailed description of the preferred embodiment thereof in reference to the accompanying drawings.

BRIEF DESCRIPTION OF THE DRAWINGS

FIG. 5 is a sectional view showing operation of the hand tool of the present invention;

FIG. 6 is another sectional view showing operation of the hand tool of the present invention;

DETAILED DESCRIPTION OF THE PREFERRED EMBODIMENT

Figure 1:
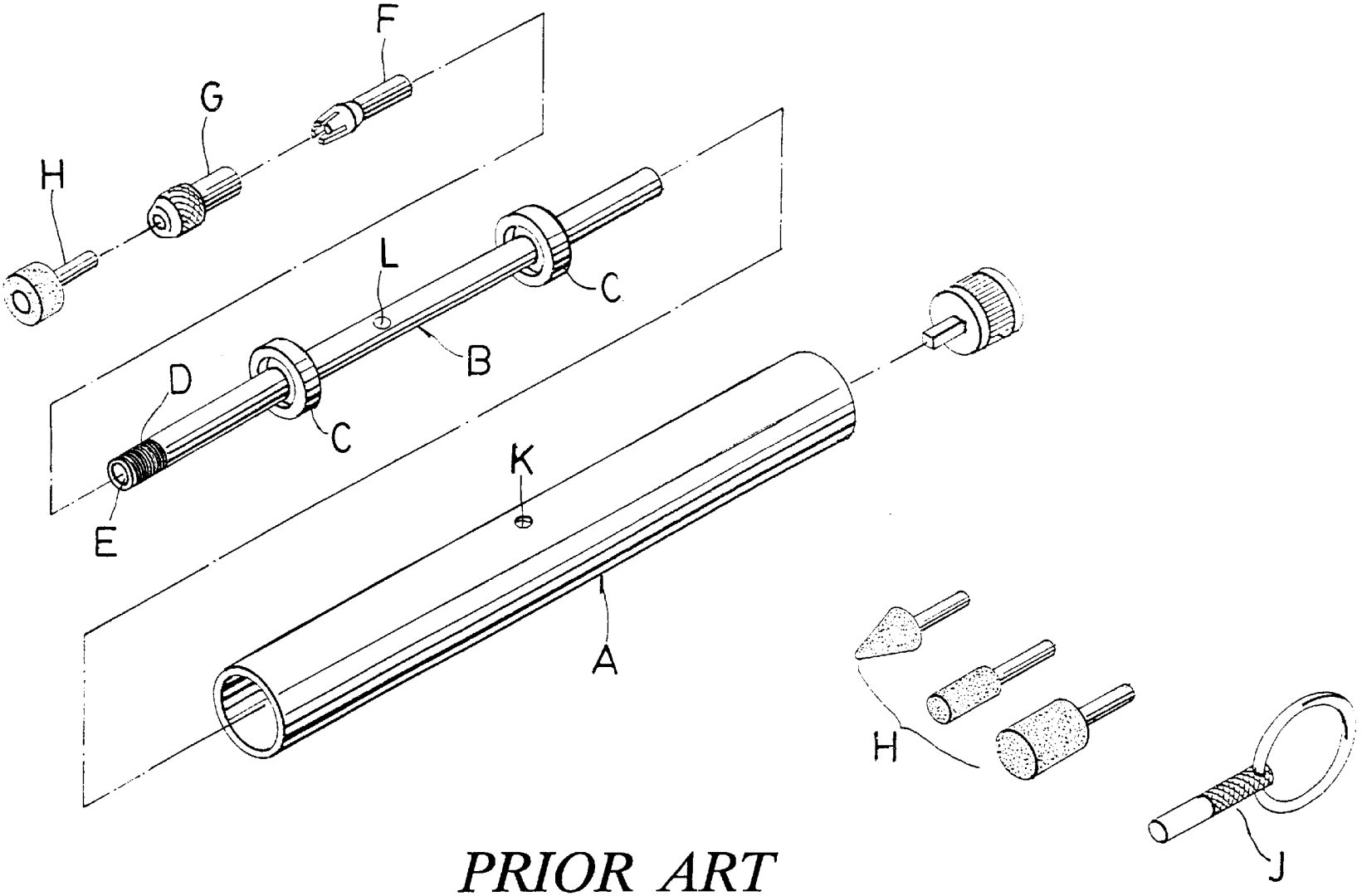
PRIOR ART FIG. 1
FIG. 1 is an analytic perspective view showing the structure of a conventional grinding tool.
Figure 2:
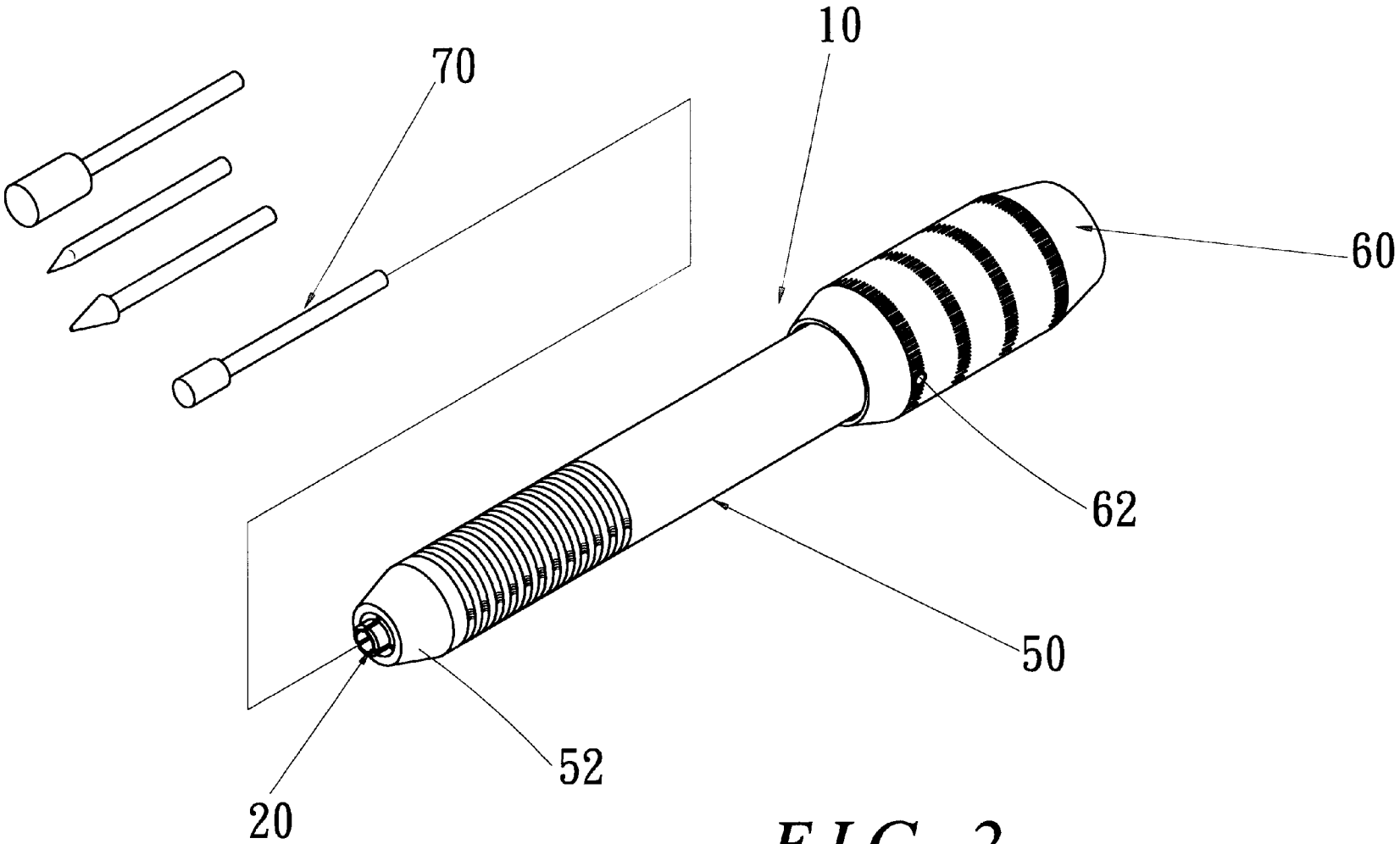
FIG. 2 is a perspective view showing the structure of the present invention.
Figure 3:
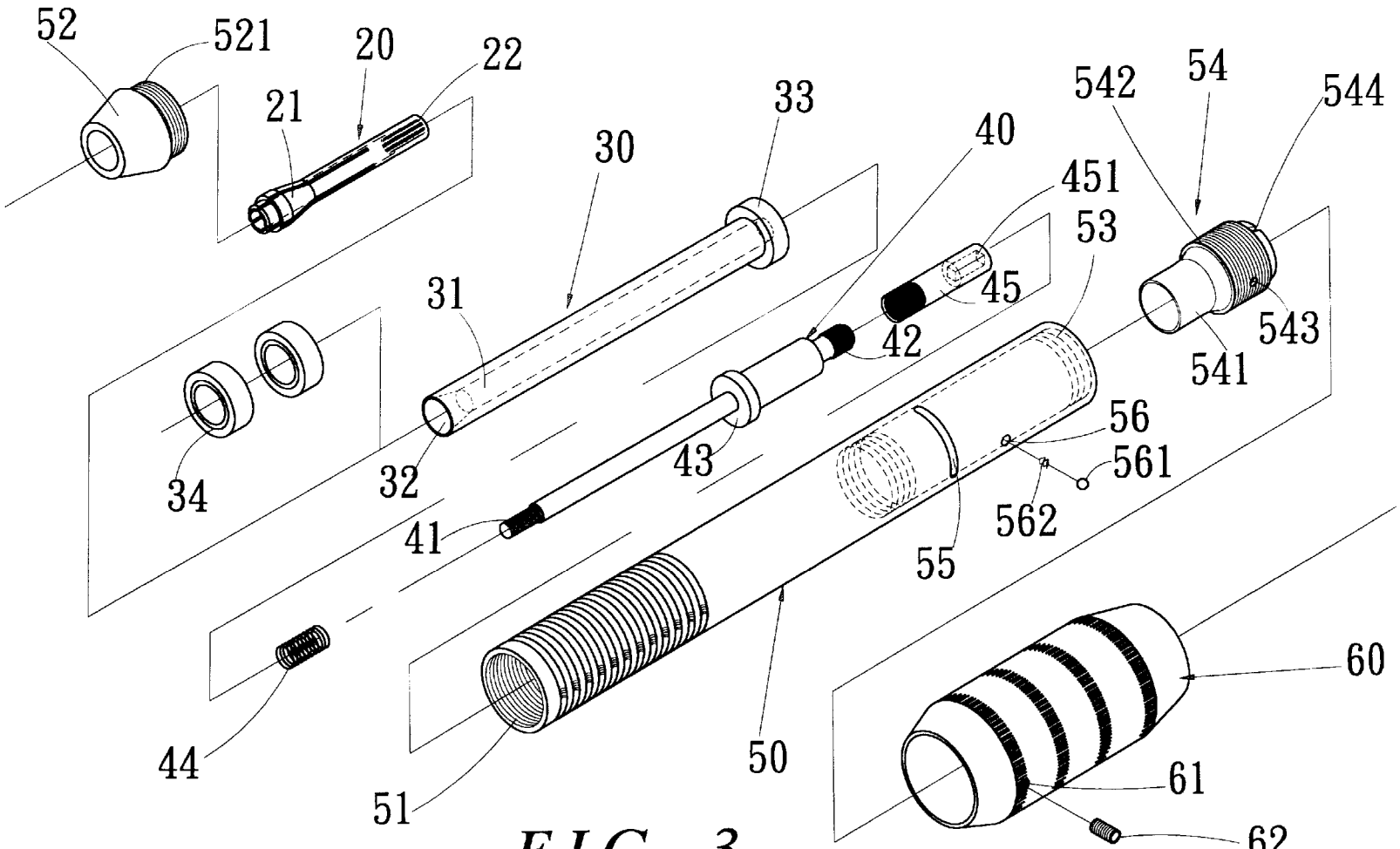
FIG. 3 is an analytic perspective view showing the structure of the present invention.

Referring to FIGS. 2, 3, the hand tool 10 of the present invention is comprised mainly of the members of a chuck 20, a positioning sleeve 30, a pushing axle rod 40, a pipe body 50 and an external sleeve 60.

Wherein, the chuck 20 is provided with slits to render itself stretchable and contractible, the front end thereof has a conical surface 21 of a suitable slope, the rear end thereof has an internal thread 22.

The positioning sleeve 30 is a hollow pipe, and has therein a central axle hole 31 of which the front end is provided with a conical surface 32. A stop round plate 33 is provided on the rear end of the positioning sleeve 30, and a plurality of bearings 34 are mounted on the positioning sleeve 30.

The pushing axle rod 40 is provided on the front end thereof with a front threaded rod section 41, and on the rear end thereof with a rear threaded rod section 42 which is mounted thereon by threading connection a driving rod 45. The pushing axle rod 40 is provided thereon at a position near the rear portion thereof with a round flange 43, a spring 44 is slipped over the pushing axle rod 40.

The pipe body 50 is a hollow pipe, and is provided on the front end thereof with an inner thread 51 for locking therein an external thread 521 of a front cover 52. The pipe body 50 is provided on the rear end thereof with an inner thread 53 for locking therein a pushing member 54. And the pipe body 50 is provided on the surface thereof with a position limiting slot 55 and a recess 6 which is placed therein a bead 561 and a elastic piece 562. The pushing member 54 is a hollow pipe, and is provided on the front end thereof with a cylinder portion 541, on a rear enlarged threaded portion 542 thereof with a hole 543 and on the rear surface thereof with a slit 544.

The external sleeve 60 is also a hollow pipe, and is provided on the outer surface thereof with an inner screw hole 61, a positioning screw rod 62 can be screwed and locked in the inner screw hole 61.

Figure 4:
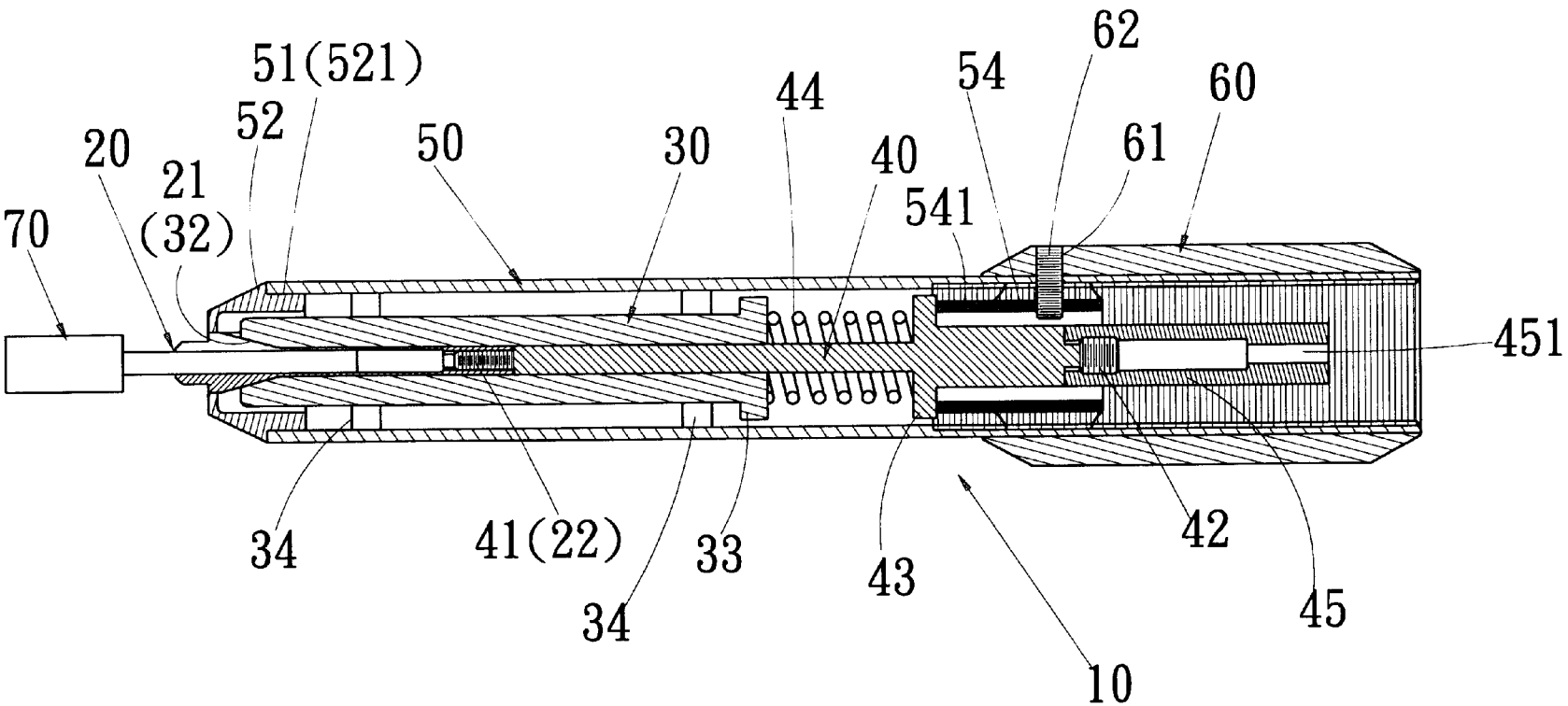
FIG. 4 is a sectional view showing the structure of the present invention.

With the above stated members, the chuck 20 is inserted into the central axle hole 31 of the positioning sleeve 30 (as shown in FIGS. 3 and 4), while the pushing axle rod 40 is inserted into the central axle hole 31 of the positioning sleeve 30 from the other end of the latter. Then the front threaded rod section 41 of the pushing axle rod 40 is screwed in the internal thread 22 of the chuck 20 with the spring 44 slipped over the pushing axle rod 40 and between the round flange 43 and the stop round plate 33 on the rear end of the positioning sleeve 30. The rear threaded rod section 42 on the rear end of the pushing axle rod 40 is screw connected with the driving rod 45. After the bearings 34 are slipped over the positioning sleeve 30, the positioning sleeve 30, the pushing axle rod 40 and the chuck 20 are together placed in the pipe body 50 with the bearings 34 abutting against the inner wall of the pipe body 50. The positioning sleeve 30 can be rotated in the bearings 34. The external thread 521 on the front cover 52 is locked in the inner thread 51 on the front end of the pipe body 50. The chuck 20 is extended out of the front cover 52. The pushing member 54 is screwed and locked in the inner thread 53 of the pipe body 50 to render the cylinder portion 541 of the pushing member 54 to abut against the rear surface of the round flange 43 on the pushing axle rod 40. The hole 543 on the rear enlarged threaded portion 542 of the pushing member 54 is exactly located at the position limiting slot 55 of the pipe body 50. The external sleeve 60 then is slipped over the pipe body 50 from the rear end of the latter, and the inner screw hole 61 of the external sleeve 60 is aligned with the position limiting slot 55 of the pipe body 50. Then the positioning screw rod 62 is screwed and locked in the inner screw hole 61 to extend through the position limiting slot 55 and the hole 543 of the pushing member 54, the hand tool 10 of the present invention can thus be completed.

Figure 7:
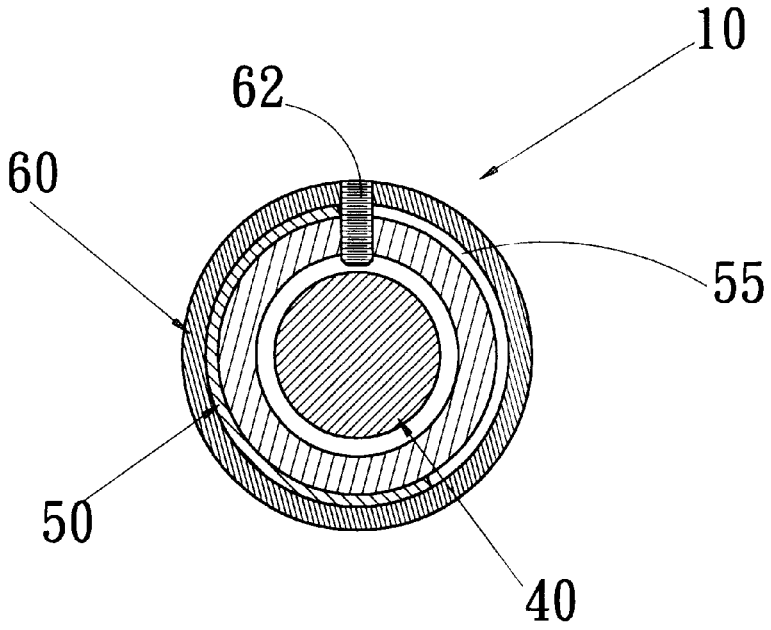
FIG. 7 is a sectional view showing operation of the external sleeve of the present invention.
Figure 8:
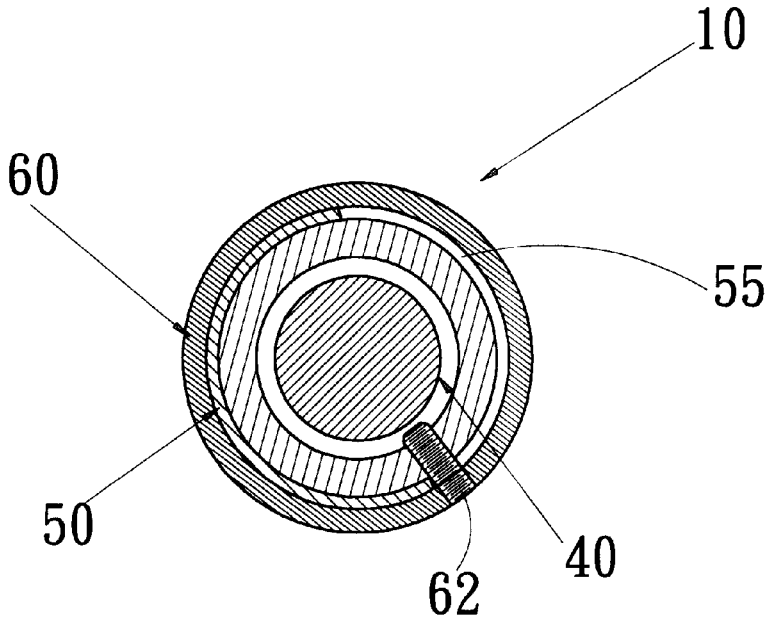
FIG. 8 is another sectional view showing operation of the external sleeve of the present invention.

Referring once more to FIGS. 5, 6, when the external sleeve 60 is rotated, the positioning screw rod 62 of the external sleeve 60 is moved in the position limiting slot 55 of the pipe body 50 (as shown in FIGS. 7 and 8), and the positioning screw rod 62 rotates the pushing member 54 (as shown in FIGS. 5 and 6) to render the cylinder portion 541 on the front end of the pushing member 54 to push forwardly the pushing axle rod 40. Thereby, the pushing axle rod 40 extends the chuck 20 on the front end thereof out of the front end of the positioning sleeve 30, hence the conical surface 21 on the front end of the chuck 20 is retracted from the conical surface 32 on the front end of the positioning sleeve 30, then a grinding member 70 can be inserted into the chuck 20. When the pushing axle rod 40 is pushed forwards, the spring 44 abutting against the round flange 43 is contracted between the round flange 43 and the stop round plate 33 of the positioning sleeve 30. If the external sleeve 60 is rotated in the contrary direction, the positioning screw rod 62 of the external sleeve 60 moves the pushing member 54 back to its original position. At this time, the cylinder portion 541 on the front end of the pushing member 54 no more pushes the pushing axle rod 40, and the latter is moved rearwards by a resilient force of the spring 44 in front of the round flange 43 on the pushing axle rod 40. When the pushing axle rod 40 moves backwards, it pulls the chuck 20 in front of it rearwards; the chuck 20 can thus enter the positioning sleeve 30. The conical surface 21 on the front end of the chuck 20 is pressed by the conical surface 32 on the front end of the central axle hole 31 of the positioning sleeve 30 in a mode of tight clamping to firmly clamp the grinding member 70. Thereby, fast changing over and accuracy of positioning of the grinding member 70 for the hand tool 10 can be achieved.

Figure 9:
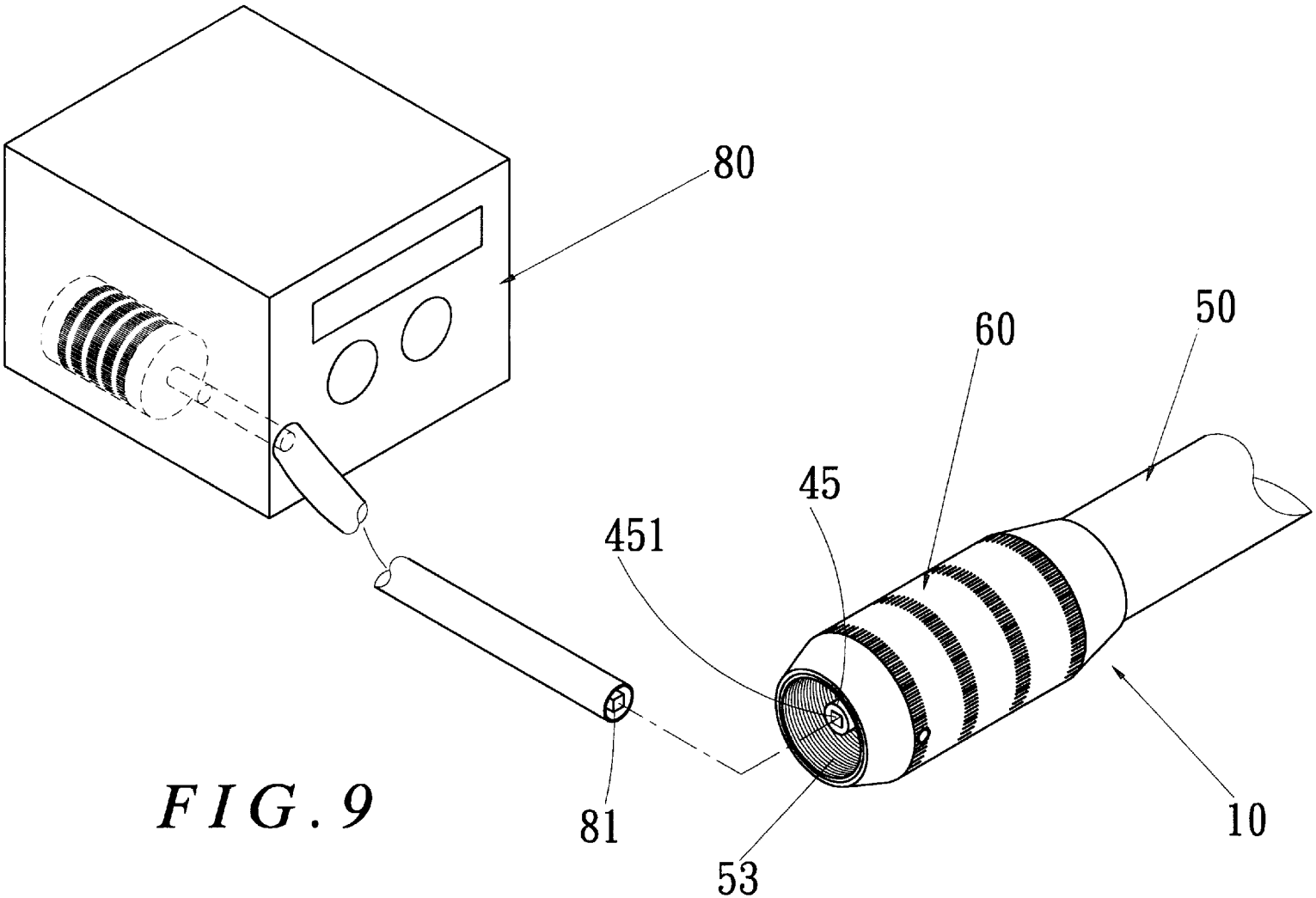
FIG. 9 is a schematic perspective view showing connection of the hand tool with a transferring rod of the present invention.

As shown in FIGS. 3, 4 and 9, the driving rod 45 in the interior and at the rear end of the pipe body 50 of the hand tool 10 is provided with a pivot hole 451 which is pivotally connected with a transferring rod 81 of a power device 80 in order that the transferring rod 81 can rotate the driving rod 45, and that the pushing axle rod 40, the positioning sleeve 30, the chuck 20 and the grinding member 70 connected in front of the driving rod 45 can be simultaneously rotated.

Figure 10:
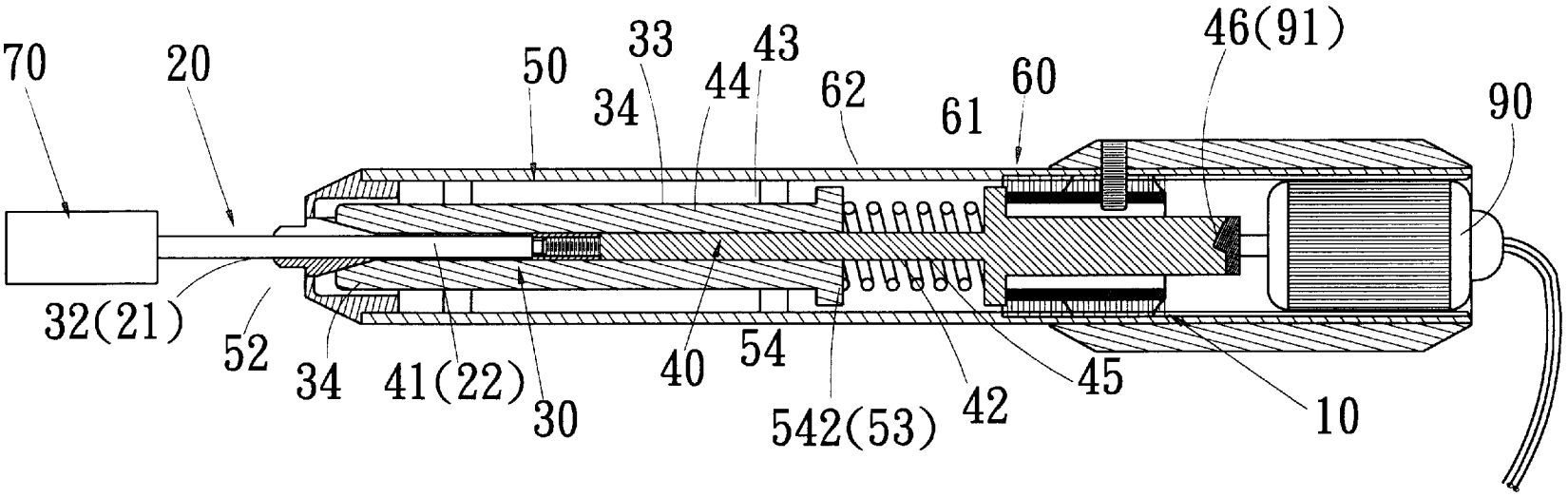
FIG. 10 is a sectional view showing operation of a motor to drive the hand tool of the present invention.
Figure 11:
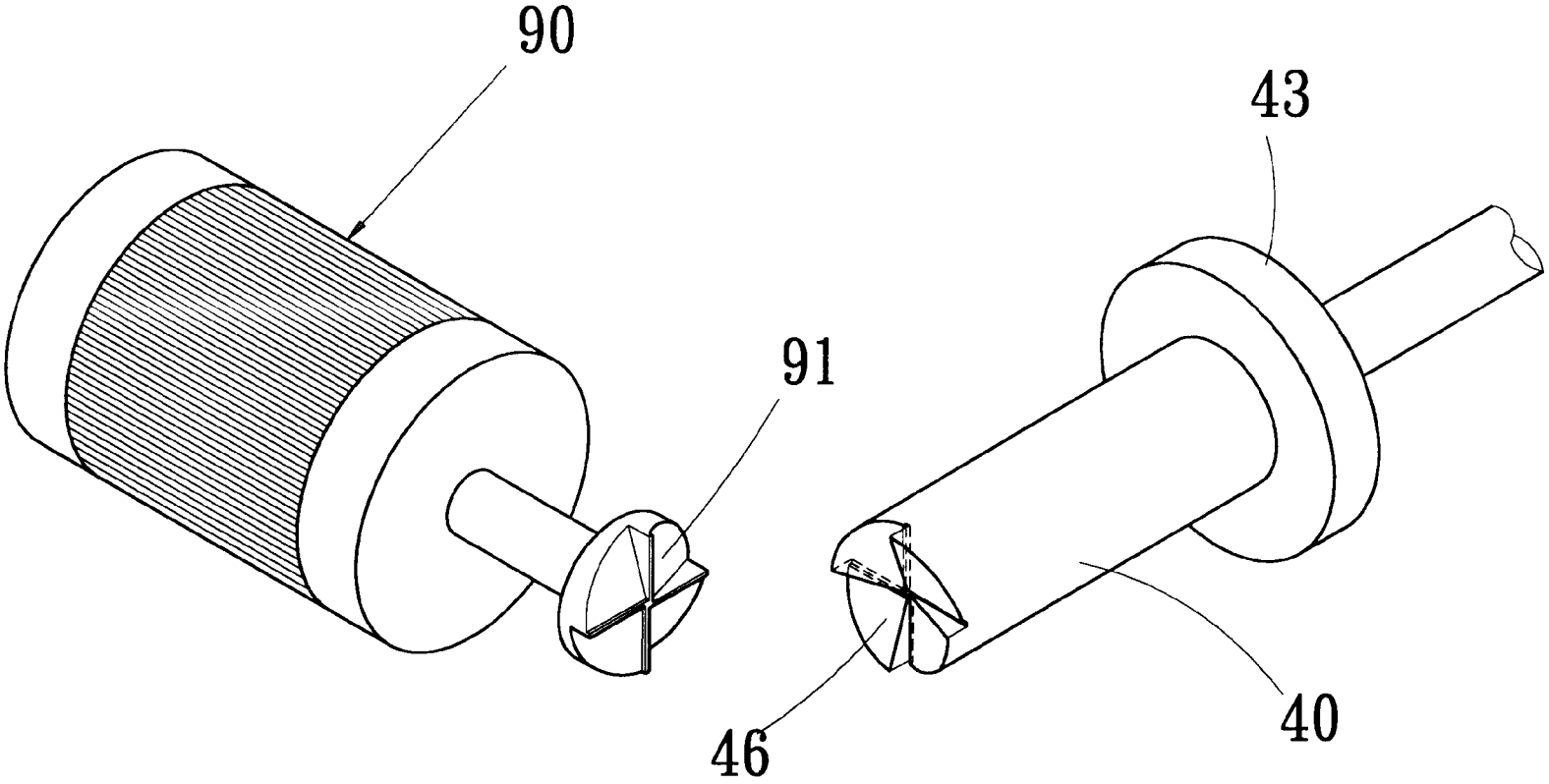
FIG. 11 is a schematic perspective view showing connection of a driving rod with the motor of the present invention.

Referring once more to FIGS. 10, 11, the hand tool 10 of the present invention is provided on the rear end of the pushing axle rod 40 with an engaging groove 46 which can be fixedly engaged with an engaging disk 91 of a motor 90, so that the motor 90 can move the driving rod 45 in the interior of the hand tool 10. And the driving rod 45 rotates together the pushing axle rod 40, the positioning sleeve 30, the chuck 20 and the grinding member 70 to do the works of grinding, trimming, polishing and carving etc.

In conclusion, by rotation of the external sleeve of the present invention to make the pushing member, the pushing axle rod and the chuck move in and out of the positioning sleeve, the chuck can clamp or release the grinding member for grinding, carving and polishing or changing over grinding members quickly, conveniently and accurately in a mode of saving time. The present invention thus is very practicable.

Having thus described my invention with practicability and improvement, what I claim as new and desire to be secured by Letters Patent of the United States are:

1. An improved structure of multi-functional hand tool comprising a chuck, a positioning sleeve, a pushing axle rod, a pipe body and an external sleeve, wherein, said chuck is provided with slits, the front end thereof has a conical surface, the rear end thereof has an internal thread;

said positioning sleeve has therein a central axle hole of which the front end is provided with a conical surface, a stop round plate is provided on the rear end of said positioning sleeve, and a plurality of bearings are mounted on said positioning sleeve;

said pushing axle rod is provided on the front end thereof with a front threaded rod section, and on the rear end thereof with a rear threaded rod section which is mounted thereon by threading connection a driving rod, said pushing axle rod is provided thereon at a position near the rear portion thereof with a round flange, a spring is slipped over said pushing axle rod;

said pipe body is provided on the front end thereof with an inner thread for locking therein an external thread on a front cover, said pipe body is provided on the rear end thereof with an inner thread for locking therein a pushing member, and said pipe body is provided on the surface thereof with a position limiting slot and a recess which is placed therein a bead and an elastic piece; said pushing member is a hollow pipe, and is provided on the front end thereof with a cylinder portion, on a rear enlarged threaded portion thereof with a hole and on the rear surface thereof with a slit;

said external sleeve is provided on the outer surface thereof with an inner screw hole, a positioning screw rod is screwed and locked in said inner screw hole;

with the above stated members, said chuck and said pushing axle rod are inserted into said central axle hole of said positioning sleeve, then said front threaded rod section of said pushing axle rod is screwed in said internal thread of said chuck with said spring slipped over said pushing axle rod and between said round flange and said stop round plate on the rear end of said positioning sleeve, said rear threaded rod section on the rear end of said pushing axle rod is screw connected with said driving rod; after said bearings are slipped over said positioning sleeve, said positioning sleeve, pushing axle rod and chuck are together placed in said pipe body, said positioning sleeve is rotatable in said bearings, said external thread on said front cover is locked in said inner thread on the front end of said pipe body, said chuck is extended out of said front cover, said pushing member is screwed and locked in said inner thread of said pipe body to render said cylinder portion of said pushing member to abut against the rear surface of said round flange on said pushing axle rod, said hole on said rear enlarged threaded portion of said pushing member is exactly located at said position limiting slot of said pipe body, said external sleeve then is slipped over said pipe body from the rear end of the latter, and said inner screw hole of said external sleeve is aligned with said position limiting slot of said pipe body, then said positioning screw rod is screwed and locked in said inner screw hole to extend through said position limiting slot and said hole of said pushing member, said hand tool thus is completed.

2. An improved structure of multi-functional hand tool as claimed in claim 1, wherein, said positioning screw rod of said external sleeve is moved in said position limiting slot of said pipe body when said external sleeve is rotated clockwise, and said positioning screw rod rotates said pushing member to render said cylinder portion on the front end of said pushing member to push forwardly said pushing axle rod, thereby, said pushing axle rod extends said chuck on the front end thereof out of the front end of said positioning sleeve, hence said conical surface on the front end of said chuck is retracted from said conical surface on the front end of said positioning sleeve, then a grinding member is inserted into said chuck; said spring in abutting against said round flange of said pushing axle rod is contracted between said round flange and said stop round plate of said positioning sleeve when said pushing axle rod is pushed forwards.

3. An improved structure of multi-functional hand tool as claimed in claim 1, wherein, said positioning screw rod of said external sleeve moves said pushing member back to its original position when said external sleeve is rotated counterclockwise, at this time, said cylinder portion on the front end of said pushing member does not push said pushing axle rod, and the latter is moved rearwards by an resilient force of said spring in front of said round flange on said pushing axle rod, during backward moving of said pushing axle rod, said pushing axle rod pulls said chuck in front of it rearwards, said chuck thus enters said positioning sleeve; said conical surface on said chuck is pressed by said conical surface on the front end of said central axle hole of said positioning sleeve in a mode of tight clamping to firmly clamp said grinding member.

* * * * *